US006605575B1

(12) United States Patent
Yamato

(10) Patent No.: US 6,605,575 B1
(45) Date of Patent: Aug. 12, 2003

(54) CUTTING FLUID COMPOSITION

(75) Inventor: Naoya Yamato, Kawasaki (JP)

(73) Assignee: Ajinomoto Co., Inc., Tokyo (JP)

( * ) Notice: Subject to any disclaimer, the term of this patent is extended or adjusted under 35 U.S.C. 154(b) by 0 days.

(21) Appl. No.: 09/850,740

(22) PCT Filed: Nov. 15, 1999

(86) PCT No.: PCT/JP99/06368

§ 371 (c)(1),
(2), (4) Date: Jul. 2, 2001

(87) PCT Pub. No.: WO00/31217

PCT Pub. Date: Jun. 2, 2000

(30) Foreign Application Priority Data

Nov. 19, 1998 (JP) ..... 10-329278

(51) Int. Cl.[7] ..... C10M 141/06; C10M 141/02
(52) U.S. Cl. ..... 508/501; 508/513; 508/579
(58) Field of Search ..... 508/513, 501, 508/579

(56) References Cited

U.S. PATENT DOCUMENTS

| | | | | |
|---|---|---|---|---|
| 3,046,225 A | | 7/1962 | Murray et al. | |
| 4,470,918 A | * | 9/1984 | Mosier | 508/513 |
| 4,543,199 A | * | 9/1985 | Kuntschik et al. | 508/513 |
| 4,548,726 A | * | 10/1985 | Morris-Sherwood et al. | 508/513 |
| 4,834,892 A | * | 5/1989 | Damin et al. | 508/513 |
| 5,227,083 A | | 7/1993 | Russo et al. | |
| 5,543,073 A | | 8/1996 | Adamy et al. | |
| 5,985,804 A | * | 11/1999 | Ashjian et al. | 508/287 |

FOREIGN PATENT DOCUMENTS

| | | | |
|---|---|---|---|
| GB | 1 101 004 | | 1/1968 |
| GB | 1 254 598 | | 11/1971 |
| JP | 51-46745 | | 4/1976 |
| JP | 51-125677 | | 11/1976 |
| JP | 0133395 | * | 10/1981 |
| JP | 56-133395 | | 10/1981 |
| JP | 62-70493 | | 3/1987 |
| JP | 5-279695 | | 10/1993 |
| JP | 1061414 | * | 9/1995 |
| JP | 0018100 | * | 8/1996 |
| JP | 9-59696 | | 3/1997 |
| JP | 9-316488 | | 12/1997 |
| JP | 10-195471 | | 7/1998 |
| WO | WO 92/07925 | | 5/1992 |

* cited by examiner

*Primary Examiner*—Jacqueline V. Howard
(74) *Attorney, Agent, or Firm*—Oblon, Spivak, McClelland, Maier & Neustadt, P.C.

(57) ABSTRACT

The object of the present invention is to provide a cutting oil composition excellent in solubility, lubricity, cutting properties, antirust ability, safety, and washing ability and reduced in foaming, and for that purpose, an N-acylamino acid having a long chain acyl group and/or a salt thereof, or an N-alkylamino acid having a long chain alkyl group and/or a salt thereof is used concurrently with an alkylalkylene oxide and/or an acylalkylene oxide.

17 Claims, No Drawings

CUTTING FLUID COMPOSITION

TECHNICAL FIELD

The present invention relates to a water-soluble cutting oil composition among cutting/grinding oils for use mainly in cutting and grinding of metals.

BACKGROUND ART

Heretofore, water-soluble surfactants have been widely used as water-soluble cutting oils, but owing to their inherent characteristics, aqueous solutions thereof are apt to produce foam. Therefore, some problems frequently occur in their applications for cutting or grinding where such foaming should be avoided. For the purpose of preventing such foaming, it has been conducted to add to such water-soluble cutting oils, a hydrocarbon, an animal or vegetable oil, a fatty acid ester, a long chain alcohol, the calcium salt of a fatty acid, a silicone oil or the like, but there exist problems that these additives remain on the surface of the material which has been cut, and the like.

That is to say, Japanese Patent Application Laid-Open (Kokai) No. 330098/'94 discloses fatty acids or fatty acid soaps as antifoaming agents, and Japanese Patent Application Laid-Open (Kokai) No. 15305/'98 discloses mixed fatty acid acylalkylene oxides for the same purpose. However, such antifoaming agents are insoluble in an aqueous surfactant solution and remain on the surface of the cutting machine or the surface of the material which has been cut, so that they might cause the corrosion of the metal. Moreover, even in the case where a silicone oil has been solubilized as described in Japanese Patent Application Laid-Open (Kokai) No. 151284/'76, it is difficult to completely remove the silicone oil by washing, owing to the high adhesiveness of the Si ions, which might, in turn, cause an adverse influence on another working step and lead to quality deterioration such as the occurrence of rust.

As water-soluble cutting/grinding oils (i.e., water-soluble cutting/abrading oils) having an antifoaming ability, Japanese Patent Application Laid-open (kokai) No. 119925/'90 discloses a water-soluble surfactant composition using concurrently both a castor oil fatty acid salt and a carboxylic acid salt, and Japanese Patent Application Laid-Open (Kokai) No. 277536/'90 discloses a salt of the condensate of an oxycarboxylic acid. However, it is necessary to extremely heighten the pH for the preparation of their aqueous solutions, and therefore, there is caused such problems that alkali corrosion tends to occur on metals, printed boards and the like. Moreover, the fatty acids are poor in hard water resistance (i.e., they tend to be precipitated as their salts from hard water), and the fatty acid calcium salt remains sometimes on the cutting machine and the material which has been cut. Furthermore, they possess inconveniences in handling such as bad smell, eruption of the skin, and the like.

As water-soluble cutting/grinding oils having an excellent metal corrosion-preventing effect, acylamino acid salts such as acylglutamic acid salts are disclosed in Japanese Patent Application Laid-Open (Kokai) No. 90645/'74 and Japanese Patent Publication (Kokoku) No. 46745/'76. They have lubricity, washing ability, and solubility and are excellent in skin irritation (i.e., very low in skin irritation), but has a problem of insufficient antifoaming ability. Japanese Patent Application Laid-Open (Kokai) No. 39177/'82 describes an attempt to enhance antifoaming ability with the use of a branched acylamino acid (i.e., an acylamino acid whose acyl group is a branched-chain acyl group, which attempt however results in not always satisfactory results.

Japanese Patent Application Laid-Open (Kokai) No. 59696/'97 discloses as a cutting fluid, a surfactant composition comprising an anionic surfactant of sulfate ester-type, carboxylic acid-type, or the like and a nonionic surfactant of Pluronic-type polyether or the like. However, their antifoaming ability is insufficient, and a cutting agent composition containing the sulfate ester-type anionic surfactant disclosed solely as anionic surfactant in the Examples of the patent document, has a poor antirust ability, so that it is necessary to add an antirust.

DISCLOSURE OF THE INVENTION

It is an object of the present invention to provide a cutting oil composition having antifoaming ability, solubility, lubricity, antirust ability, and washing ability, and excellent in safety and biodegradability, as well as easy to handle.

As a result of extensive and intensive studies in view of such circumstances, the present inventors have found that the above object can be achieved by the combined or concurrent use of an N-acylamino acid having a long chain acyl group (i.e., an N-acylamino acid whose acyl group is a long chain acyl group) and/or a salt thereof, or an N-alkylamino acid having a long chain alkyl group (i.e., an N-alkylamino acid whose alkyl group is a long chain alkyl group) and/or a salt thereof (Component (A)) and an acylalkylene oxide and/or an alkylalkylene oxide (Component (B)), and thus have accomplished the present invention.

Namely, the present invention relates to a cutting oil composition comprising the following Components (A) and (B):

Component (A); one or two or more selected from the group consisting of an N-acylamino acid having a long chain acyl group and/or a salt thereof, or an N-alkylamino acid having a long chain alkyl group and/or a salt thereof, and Component (B); an acylalkyiene oxide and/or an alkylalkylene oxide.

The present invention will be explained in greater detail below.

As examples of an N-acylamino acid having a long chain acyl group as component (A) according to the present invention, there may be mentioned N-acyl acidic amino acids such as N-acylglutamic acids, N-acylaspartic acids, N-acyl-homocysteic acid, and the like; N-acyl neutral amino acids such as N-acylglycines, N-acylalanines, N-acyl-β-alanines, N-acylthreonines, N-acylserines, N-acylphenylalanines, and the like; N-acyl-N-alkyl acidic amino acids such as N-acyl-N-methylglutamic acids, N-acyl-N-methylaspartic acids, N-acyl-N-methylhomocysteic acids, and the like; N-acyl-N-alkyl neutral amino acids such as N-acyl-N-methyl-β-alanines, N-acylsarcosines, and the like; diacyl basic amino acids such as diacyllysines, diacylornithines, and the like; and the like. These can be used regardless of their optical isomerism.

Among these acylamino acids, N-acylglutamic acids, N-acylaspartic acids, N-acylglycines, N-acylalanines, N-acyl-β-alanines, and N-acyl-N-methyl-β-alanines are preferred from the viewpoints of safety and solubility. Further, from the viewpoint of antifoaming ability and washing ability, N-acylglutamic acids and N-acylaspartic acids are preferred, and N-acylglutamic acids are most excellent. The reason why these acyl acidic amino acids are particularly excellent in washing ability is considered to be because fine metal powder particles formed upon cutting are trapped by the chelating effect of the two carboxylic groups of the acidic amino acid moiety, which results in that they are easily dispersed into the cutting oil without remaining on the surface of the material which has been cut, so that they are easily washed away with water and the like after the use.

The number of carbon atoms of the acyl group of an N-acylamino acid having a long chain acyl group, of Component (A) according to the present invention is preferably from 8 to 18, more preferably from 10 to 14. When the number of carbon atoms is less than 8, N-acylamino acids are observed to be decreased both in washing ability and safety. When the number of carbon atoms is larger than 18, they are decreased in solubility, and the stability of the resulting cutting oil composition therefrom sometimes decreases at low temperatures. Particularly preferred are lauroyl group having 12 carbon atoms and the acyl group of coconut oil fatty acid containing lauroyl group as the main component.

As examples of an N-alkylamino acid having a long chain alkyl group as Component (A) according to the present invention, there may be mentioned N-alkyl acidic amino acids such as N-alkylglutamic acids, N-alkylaspartic acids, N-alkylhomocysteic acid, and the like; N-alkyl neutral amino acids such as N-alkylglycines, N-alkylalanines, N-alkyl-β-alanines, N-alkylthreonines, N-alkylserines, N-alkylphenylalanines, and the like; N-dialkyl acidic amino acids such as N-dialkylglutamic. acids, N-dialkylaspartic acids, N-dialkylhomocysteic acid, and the like; N-dialkyl neutral amino acids such as N-dialkyl-β-alanines, N-dialkylglycines, and the like; dialkyl basic amino acids such as dialkyllysines, dialkylornithines, and the like; and the like. These can be used regardless of their optical isomerism.

The number of carbon atoms of the alkyl group of an N-alkylamino acid having an alkyl group, of the Component (A) according to the present invention, is preferably from 8 to 18, more preferably from 10 to 14. When the number of carbon atoms is less than 8, N-alkylamino acids are observed to be decreased both in washing ability and safety. When the number of carbon atoms is larger than 18, they are decreased in solubility, and the stability of the resulting cutting oil composition therefrom sometimes decreases at low temperatures. Particularly preferred is lauryl group having 12 carbon atoms.

According to the present invention, N-acylamino acids are more preferable than N-alkyl amino acids from the viewpoint of antirust ability and lubricity.

As examples of salts of Component (A) according to the present invention, there may be mentioned inorganic salts such as sodium salts, potassium salts, magnesium salts, ammonium salts, and the like, and organic salts such as arginine salts, lysine salts, histidine salts, ornithine salts, triethanolamine salts, and. the like. Among these salts, sodium salts, potassium salts, and triethanolamine salts are preferred from the viewpoint of solubility, and more preferred are potassium salts and triethanolamine salts. Particularly preferred are triethanolamine salts.

The acylalkylene oxide and alkylalkylene oxide of the Component (B) according to the present invention, are represented by the following general Formula (1):

$$RO(X)_nH \quad (1)$$

[wherein, X represents an alkylene oxide, n represents an integer, and R represents an acyl group or an alkyl group].

The number of carbon atoms of the acyl group of an acylalkylene oxide according to the present invention is preferably from 14 to 24, and as examples thereof, there may be mentioned myristoyl group, palmitoyl group, stearoyl group, isocetanoyl group, isostearoyl group, octyldodecanoyl group, decyltetradecanoyl group, and the like. Among them, from the viewpoint of antifoaming ability and solubility, the number of carbon atoms is more preferably from 18 to 24, and particularly preferred is from 18 to 20. When the number of carbon atoms is less than 14, acylalkylene oxides are observed to be decreased in antifoaming ability, while when the number of carbon atoms is larger than 24, they are decreased in solubility, and the stability of the resulting cutting oil composition therefrom sometimes decreases at low temperatures. In addition, branched-chain acyl groups are more preferable than straight-chain ones from the view-point of antifoaming ability and solubility.

As examples of the oxide group of an acylalkylene oxide according to the present invention, there may be mentioned ethylene oxide, propylene oxide, isopropoxide, and the like. n is preferably from 1 to 30, more preferably from 5 to 20, and further more preferably from 5 to 10. When n is larger than 30, acylalkylene oxides are sometimes too high in foaming ability, while when n is 0, they are decreased in solubility, and the stability of the resulting cutting oil composition therefrom sometimes decreases at low temperatures.

The number of carbon atoms of the alkyl group of an alkylalkylene oxide according to the present invention is preferably from 14 to 24, and as examples thereof, there may be mentioned myristyl group, stearyl group, isocetyl group, isostearyl group, octyldodecyl group, decyltetradecyl group, and the like. Among them, from the viewpoint of antifoaming ability and solubility, the number of carbon atoms is more preferably from 18 to 24, and particularly preferred is from 18 to 20. When the number of carbon atoms is less than 14, alkylalkylene oxides are observed to be decreased in antifoaming ability, while when the number of carbon atoms is larger than 24, they are decreased in solubility, and the stability of the resulting cutting oil composition therefrom sometimes decreases at low temperatures. In addition, branched-chain alkyl groups are more preferable than straight-chain ones from the viewpoint of antifoaming ability and solubility.

As examples of the oxide group of an alkylalkylene oxide according to the present invention, there may be mentioned ethylene oxide, propylene oxide, isopropoxide, and the like, n is preferably from 1 to 30, more preferably from 5 to 20, further more preferably from 5 to 10. When n is larger than 30, alkylalkylene oxides are sometimes too high in foaming ability, while when n is 0, they are decreased in solubility, and the stability of the resulting water-soluble cutting/grinding oil composition sometimes decreases at low temperatures.

According to the present invention, from the viewpoint of antifoaming ability, the alkylalkylene oxides are more preferable than the acylalkylene oxides.

As Component (B) according to the present invention, the compounds represented by the general Formula (1) may be used solely or as a mixture of two or more thereof.

In cutting oil composition according to the present invention, the mixing ratio of Component (A) to Component (B) can be usually from 99:1 to 1:99 in terms of weight. From the viewpoints of stability at low temperatures, antirust ability, lubricity, washing ability, and antifoaming ability of the cutting oil composition resulting therefrom, the ratio is preferably from 99:1 to 50:50, more preferably from 95:5 to 85:15.

The content of the water-soluble surfactant according to the present invention for use in the cutting oil composition is optionally selected depending on the mode of the use. For fully exhibiting lubricity, antirust ability, and washing ability which are the effects of the present invention, the weight of Component (A) is preferably 50% or more of the total weight of the surfactant in the composition, more preferably 60% or more, further more preferably 70% or more, and particularly preferably 80% or more.

To the cutting oil composition of the present invention, various conventional additives can be added to such extent that they do not inhibit the effects of the present invention. As examples thereof, there may be mentioned fatty acids and salts thereof; polyhydric alcohols such as propylene glycol, glycerin, butylene glycohol, and the like; surfactants such as anionic surfactants, amphoteric surfactants, nonionic surfactants, and the like; oily agents; polymeric substances, alcohols, anti inflammatory agents, bactericides, antiseptics, antioxidants, chelating agents such as edetic acid salts, and the like; pH regulators, and the like.

The pH of the cutting oil composition of the present invention is preferably 6 or higher from the viewpoint of solubility and antirust ability.

BEST MODE FOR CARRYING OUT THE INVENTION

The following will explain the present invention in more detail by reference to the examples, but the present invention is not limited to these examples.

TEST EXAMPLE 1

Evaluation of Antifoaming Ability

For the cutting oil compositions (each in the total amount of 100 g) having a composition shown in the following Table 1, antifoaming ability was evaluated at room temperature using the following method. Namely, 50 ml of each cutting oil composition of a predetermined concentration was charged into a commercially available mixer for household use (Iwatani Sangyo K.K.), followed by stirring at 30° C. for 5 seconds, and then foam amounts (ml) at 1 minute and 5 minutes immediately after the termination of stirring were read. Then, antifoaming ability was evaluated according to the following standard for judgment.

<Standard for Judgment of Antifoaming Ability>

◎: Very good antifoaming ability (Foam amount after 5 minutes, 90 ml or less).

○: Good antifoaming ability (Foam amount after 5 minutes, 105 ml or less).

Δ: Moderate antifoaming ability (Foam amount after 5 minutes, less than 140 ml).

X: Poor antifoaming ability (Foam amount after 5 minutes, 140 ml or more).

TABLE 1

| | Example | | | | | | | | |
|---|---|---|---|---|---|---|---|---|---|
| | 1 | 2 | 3 | 4 | 5 | 6 | 7 | 8 | 9 |
| N-cocoylglutamic acid monoTEA salt | 0.45 | 0.45 | 0.45 | 0.45 | 0.45 | 0.35 | | | |
| N-cocoylglutamic acid disodium salt | | | | | | | 0.45 | 0.45 | 0.45 |
| POE alkyl ether sulfuric acid sodium salt | | | | | | | | | |
| Sodium laurate | | | | | | | | | |
| POE(12)monoisostearate | 0.05 | | | | | | | | |
| POE(10)isostearyl ether | | 0.05 | | | | | 0.05 | | |
| POE(10)octyldodecyl ether | | | 0.05 | | | 0.15 | | 0.05 | |
| POE(10)monostearate | | | | 0.05 | | | | | |
| POE(10)stearyl ether | | | | | 0.05 | | | | 0.05 |
| POE(15)lauryl ether | | | | | | | | | |
| Triethanolamine | 0.14 | 0.14 | 0.14 | 0.14 | 0.14 | 0.11 | | | |
| Water | rest | rest | rest | rest | rest | rest | rest | rest | rest |
| pH | 6.7 | 6.7 | 6.8 | 6.8 | 6.8 | 6.8 | 6.1 | 6.1 | 6.1 |
| Foam amount after 0 minute (ml) | 150 | 125 | 130 | 140 | 120 | 100 | 130 | 140 | 140 |
| Foam amount after 1 minute (ml) | 120 | 100 | 100 | 110 | 90 | 65 | 100 | 110 | 120 |
| Foam amount after 5 minutes (ml) | 105 | 90 | 80 | 95 | 80 | 60 | 90 | 90 | 105 |
| Antifoaming ability | ○ | ◎ | ◎ | ◎ | ◎ | ◎ | ◎ | ◎ | ○ |

| | Comparative Example | | | | | | | | |
|---|---|---|---|---|---|---|---|---|---|
| | 1 | 2 | 3 | 4 | 5 | 6 | 7 | 8 | 9 |
| N-cocoylglutamic acid monoTEA salt | | 0.5 | 0.45 | | | | | | |
| N-cocoylglutamic acid disodium salt | 0.5 | | | | | | | | |
| POE alkyl ether sulfuric acid sodium salt | | | | 0.45 | 0.45 | 0.45 | 0.45 | 0.5 | |
| Sodium laurate | | | | | | | | | 0.45 |
| POE(12)monoisostearate | | | | 0.05 | | | | | |
| POE(10)isostearyl ether | | | | | 0.05 | | | | |
| POE(10)octyldodecyl ether | | | | | | 0.05 | | | |
| POE(10)monostearate | | | | | | | | | |
| POE(10)stearyl ether | | | | | | | 0.05 | | 0.05 |
| POE(15)lauryl ether | | | 0.05 | | | | | | |
| Triethanolamine | | 0.16 | 0.14 | | | | | | |
| Water | rest | rest | rest | rest | rest | rest | rest | rest | rest |
| pH | 6.0 | 6.7 | 6.8 | 4.5 | 5.0 | 5.7 | 5.7 | 5.8 | 9.59 |
| Foam amount after 0 minute (ml) | 210 | 170 | 160 | 200 | 200 | 210 | 210 | 230 | 275 |
| Foam amount after 1 minute (ml) | 195 | 150 | 145 | 180 | 190 | 190 | 180 | 215 | 270 |
| Foam amount after 5 minutes (ml) | 160 | 130 | 115 | 150 | 140 | 60 | 140 | 170 | 240 |
| Antifoaming ability | X | Δ | Δ | X | X | X | X | X | X |

TEST EXAMPLE 2

Measurement of Stability in Dissolved State

For the cutting oil compositions (each in the total amount of 100 g) having a composition shown below in Table 2, the stability in dissolved states was measured at 25° C. and 5° C. The stability in dissolved states was evaluated according to the standard for judgment given below.

As is apparent from the results, the compositions of the present invention have excellent stability in dissolved states. Also, they have such satisfactory washing ability that fine cut metal powder particles and the like are easily dispersed in the cutting oil and are easily washed away with water and the like after use without remaining on the material which has been cut.

<Standard for Judgment of Stability in Dissolved State>

○: Stable both at 25° C. and 5° C. for 1 week.

Δ: Stable at 25° C. for 1 week, but separation or precipitation occurs at 5° C. in 1 week.

X: Separation or precipitation occurs at 25° C. in 1 week.

TABLE 2

| | Example | | | | | | | Comparative Example | | | | |
|---|---|---|---|---|---|---|---|---|---|---|---|---|
| | 10 | 11 | 12 | 13 | 14 | 15 | 16 | 17 | 18 | 10 | 11 | 12 |
| N-cocoylglutamic acid monoTEA salt | 18 | 18 | 18 | 18 | 18 | 10 | | | | | | |
| N-cocoylglutamic acid disodium salt | | | | | | | 18 | 18 | 18 | | | |
| Sodium laurate | | | | | | | | | | 18 | | |
| POE(12)monoisostearate | 2 | | | | | | | | | | | |
| POE(10)isostearyl ether | | 2 | | | | | 2 | | | | 20 | |
| POE(10)octyldodecyl ether | | | 2 | | | 10 | | 2 | | 2 | | 20 |
| POE(10)monostearate | | | | 2 | | | | | | | | |
| POE(10)stearyl ether | | | | | 2 | | | | 2 | | | |
| Triethanolamine | 5.6 | 5.6 | 5.6 | 5.6 | 5.6 | 3.1 | | | | | | |
| Water | rest | rest | rest | rest | rest | rest | rest | rest | rest | rest | rest | rest |
| pH | 7.0 | 7.0 | 7.1 | 6.9 | 7.1 | 7.1 | 6.7 | 6.7 | 6.8 | 10.0 | 2.6 | 4.0 |
| Stability in dissolved state | ○ | ○ | ○ | ○ | ○ | ○ | ○ | ○ | ○ | Δ | X | X |

TEST EXAMPLE 3

Evaluation of Lubricity

For the cutting oil compositions (each in the total amount of 100 g) having a composition shown below in Table 3, load resistance was deteimined at a concentration of 3.0 wt % in accordance with the four-ball lubricating oil test method (¾ inch steel ball Cr steel JIS, SUJ-2) defined in JIS (Japanese Industrial Standard), and lubricity was evaluated according to the following standard for judgment.

<Standard for Judgment of Lubricity>

○: Load resistance exceeds 4.5 kg/cm$^2$.

Δ: Load resistance exceeds 3.5 kg/cm$^2$.

X: Load resistance is 3.0 kg/cm$^2$ or less.

TABLE 3

| | Example | Comparative Example | | |
|---|---|---|---|---|
| | 19 | 13 | 14 | 15 |
| N-cocoylglutamic acid monoTEA salt | 2.7 | | | |
| POE alkyl ether sulfuric acid sodium salt | | 2.7 | | |

TABLE 3-continued

| | Example | Comparative Example | | |
|---|---|---|---|---|
| | 19 | 13 | 14 | 15 |
| Sodium laurate | | | 2.7 | |
| POE alkylether actetic acid sodium salt | | | | 2.7 |
| POE(10)octyl dodecyl ether | 0.3 | 0.3 | 0.3 | 0.3 |
| Triethanolamine | 0.84 | | | |
| Water | rest | rest | rest | rest |
| Lubricity | ○ | X | ○ | Δ |

TEST EXAMPLE 4

Evaluation of Antirust Ability

For the cutting oil compositions (each in the total amount of 100 g) having a composition shown below in Table 4, antirust ability was evaluated at a concentration of 0.1 wt %, using test pieces of JIS. K. 2510 in accordance with the antirust performance test method defined in JIS (Japanese Industrial Standard) according to the following standard for judgment.

<Standard for Judgment of Antirust Ability>

○: No rust appears on the test pieces after stirring at 60° C. for 1 hour.

Δ: 0 to 5% of the test piece surface is covered with rust after stirring at 60° C. for 1 hour.

X: 5% or more of the test piece surface is covered with rust after stirring at 60° C. for 1 hour.

TABLE 4

| | Example | | Comparative Example | | |
|---|---|---|---|---|---|
| | 20 | 21 | 16 | 17 | 18 |
| N-cocoylglutamic acid monoTEA salt | 0.09 | | | | |
| N-cocoylglutamic acid disodium salt | | 0.09 | | | |
| POE alkylether sulfuric acid sodium salt | | | 0.09 | | |
| sodium laurate | | | | 0.09 | |
| POE alkylether actetic acid sodium salt | | | | | 0.09 |
| POE(10)octyl dodecyl ether | 0.01 | 0.01 | 0.01 | 0.01 | 0.01 |

TABLE 4-continued

| | Example | | Comparative Example | | |
|---|---|---|---|---|---|
| | 20 | 21 | 16 | 17 | 18 |
| Triethanolamine | 0.028 | | | | |
| Water | rest | rest | rest | rest | rest |
| pH | 6.86 | 6.34 | 7.12 | 7.88 | 7.02 |
| Lubricity | ○ | ○ | X | ○ | Δ |

From the above Test Examples 1 to 4, it is apparent that it is the compositions of the present invention that exhibit excellent performance in all of antifoaming ability, stability in dissolved state, lubricity, and antirust ability.

INDUSTRIAL APPLICABILITY

According to the present invention, it is possible to provide a cutting oil composition excellent in stability in dissolved state in the range of low temperatures to ordinary temperatures, solubility, dispersibility of cut metal powder particles, washing ability upon washing away after use, lubricity, cutting property, antirust ability, safety, and poor-foaming property, which remains in only small amounts on the surface of the material which has been cut.

What is claimed is:

1. A cutting oil composition, comprising the following Components (A) and (B):

Component (A); one or two or more selected from the group consisting of N-acylamino acids having a long chain acyl group and salts thereof, and Component (B); a branched-chain acylalkylene oxide and/or a branched-chain alkylalkylene oxide.

2. The cutting oil composition of claim 1, wherein the amino acid moiety of said Component (A) is an acidic amino acid.

3. The cutting oil composition of claim 1, wherein said Component (B) is a branched-chain alkylalkylene oxide.

4. The cutting oil composition of claim 1, wherein the number of carbon atoms of the acyl group moiety of said Component (A) is 8–18.

5. The cutting oil composition of claim 1, wherein the number of carbon atoms of the acyl group moiety of said Component (B) is 14–24.

6. The cutting oil composition of claim 1, wherein said Component (A) and said Component (B) is in a ratio of 99:1–50:50 in terms of weight, and the weight of said Component (A) is 50% or more of the total weight of the surfactant in the composition.

7. The cutting oil composition of claim 1, which has a ph of 6 or more.

8. The cutting oil composition of claim 2, wherein said Component (B) is a branched-chain alkylalkylene oxide and/or a branched-chain acylalkylene oxide.

9. The cutting oil composition of claim 2, wherein the number of carbon atoms of the acyl moiety of said Component(A) is 8–18.

10. The cutting oil composition of claim 1, wherein the number of carbon atoms of the acyl moiety of said Component (A) is 8–18.

11. The cutting oil composition of claim 2, wherein the number of carbon atoms of the acyl or alkyl group moiety of said Component (B) is 14–24.

12. The cutting oil composition of claim 1, wherein the number of carbon atoms of the acyl or alkyl group moiety of said Component (B) is 14–24.

13. The cutting oil composition of claim 2, wherein said Component (A) and said Component (B) is in a ratio of 99:1–50:50 in terms of weight, and the weight of said Component (A) is 50% or more of the total weight of the surfactant in the composition.

14. The cutting oil composition of claim 1, wherein said Component (A) and said Component (B) is in a ratio of 99:1–50:50 in terms of weight, and the weight of said Component (A) is 50% or more of the total weight of the surfactant in the composition.

15. The cutting oil composition of claim 2, which has a pH of 6 or more.

16. The cutting oil composition of claim 1, which has a pH of 6 or more.

17. The cutting oil composition of claim 1, which has a good antifoaming property.

* * * * *

UNITED STATES PATENT AND TRADEMARK OFFICE

CERTIFICATE OF CORRECTION

PATENT NO. : 6,605,575 B1
DATED : August 12, 2003
INVENTOR(S) : Naoya Yamato

It is certified that error appears in the above-identified patent and that said Letters Patent is hereby corrected as shown below:

Column 10,
Lines 9-11, cancel Claim 8.
Line 12, "9." should read -- 8. --;
Line 15, "10." should read -- 9. --;
Line 19, "11." should read -- 10. --;
Line 22, "12." should read -- 11. --;
Line 25, "13." should read -- 12. --;
Line 30, "14." should read -- 13. --;
Line 36, "15." should read -- 14. --;
Line 38, "16." should read -- 15. --;
Line 40, "17." should read -- 16. --.

Signed and Sealed this

Sixteenth Day of May, 2006

JON W. DUDAS
*Director of the United States Patent and Trademark Office*